US005083167A

United States Patent [19]

Fukushima et al.

[11] Patent Number: 5,083,167

[45] Date of Patent: Jan. 21, 1992

[54] IMAGE FORMING APPARATUS FOR SUPPLYING DIFFERENT AMOUNTS OF ELECTRIC CHARGE TO AN END PORTION OF A TRANSFER MATERIAL

[75] Inventors: Satoru Fukushima, Tokyo; Kenichi Takeda, Yokohama; Atsushi Takeda, Kawasaki; Yoshio Uchikawa, Yokohama; Takashi Hasegawa, Matsudo, all of Japan

[73] Assignee: Canon Kabushiki Kaisha, Tokyo, Japan

[21] Appl. No.: 519,764

[22] Filed: May 7, 1990

[30] Foreign Application Priority Data

May 9, 1989 [JP] Japan ..... 1-115533
Aug. 31, 1989 [JP] Japan ..... 1-225376
Aug. 31, 1989 [JP] Japan ..... 1-225378

[51] Int. Cl.[5] ..... G03G 15/16
[52] U.S. Cl. ..... 355/274; 355/326
[58] Field of Search ..... 355/274, 272, 271, 275, 355/276, 217, 208, 326, 327; 430/33, 42, 48, 126

[56] References Cited

U.S. PATENT DOCUMENTS 4,190,348 2/1980 Friday ..... 355/274
4,860,048 8/1989 Itoh et al. .
4,888,621 12/1989 Ohno ..... 355/326
4,912,515 3/1990 Amemiya et al. .
4,914,737 4/1990 Amemiya et al. .
4,935,776 6/1990 Fukui ..... 355/274 X
4,941,003 7/1990 Takeda et al. .

FOREIGN PATENT DOCUMENTS 0298505 1/1989 European Pat. Off. .
56-14271 2/1981 Japan .
58-118680 7/1983 Japan .
59-13264 1/1984 Japan .
61-212871 9/1986 Japan .
62-209558 9/1987 Japan .
62-223766 10/1987 Japan .

*Primary Examiner*—R. L. Moses
*Attorney, Agent, or Firm*—Fitzpatrick, Cella, Harper & Scinto

[57] ABSTRACT

An image forming apparatus includes a movable image bearing member; an image forming device for forming a toner image on the image bearing member; a transfer device for electrostatically transferring the toner image from the image bearing member onto a transfer material at an image transfer position; a transfer material carrying device for carrying the transfer material to the transfer position; wherein the transfer device supplies different electric charge amount per unit area to an end of the transfer material in a direction of conveyance of the transfer material by the transfer material carrying device and to another portion of the transfer material.

103 Claims, 8 Drawing Sheets

IMAGE FORMING APPARATUS FOR SUPPLYING DIFFERENT AMOUNTS OF ELECTRIC CHARGE TO AN END PORTION OF A TRANSFER MATERIAL

FIELD OF THE INVENTION AND RELATED ART

The present invention relates generally to an image forming apparatus, and more particularly to a color image forming apparatus such as a multi-color electrophotographic copying apparatus including a plurality of developing devices and a color printer used as an output device for a facsimile machine, a computer or the like.

Various multi-color electrophotographic apparatuses have been proposed. FIG. 3 shows a typical multi-color electrophotographic copying apparatus equipped with a developing device of a rotary type.

In FIG. 3, the multi-color electrophotographic apparatus includes an image bearing member in the form of a photosensitive drum 1 supported for rotation in the direction indicated by an arrow. Around it, image forming means are disposed. The image forming means may be of any type. In the example, the means include a primary charger for uniformly charging the photosensitive drum 1, exposure means 3 in the form of a laser beam exposure device, for example, for forming an electrostatic latent image on the photosensitive drum 1 by applying color-separated light images or a beam corresponding thereto, and a rotary type developing device 4 for visualizing the electrostatic latent images on the photosensitive drum 1.

The rotary type developing device 4 includes four developing devices 4Y, 4M, 4C and 4BK containing a yellow developer, a magenta developer, a cyan developer and a black developer, and a generally cylindrical housing 4*a* rotatably supported to support the four developing devices 4Y, 4M, 4C and 4BK. In the rotary type developing device 4, by the rotation of the housing 4*a*, a desired one of the developing devices is brought to a position where it faces to the outer surface of the photosensitive drum to develop the electrostatic latent image on the photosensitive drum. By rotation of the housing 4*a*, four full color development is possible.

The visualized image on the photosensitive drum, that is, the toner image thereon, is transferred onto the transfer material P supported and conveyed on an image transfer device 5. In this example, the transfer device 5 is in the form of a transfer drum rotatably supported. As will be understood from FIGS. 3 and 4, the transfer drum 5 includes a cylinder 5*a*, an image transfer charger 5*b* disposed in the cylinder 5*a* to constitute the image transfer means, and a transfer material gripper 5*c* for gripping the transfer material supplied from the sheet supply device not shown. Inside and outside the transfer drum 5, there are disposed an inside discharger 5*d* and an outside discharger 5*e* constituting discharging means, respectively. A transfer material carrying sheet 501 is stretched to cover the outside of an opening of the cylinder 5*a*. The transfer material carrying sheet 501 is usually made of a dielectric sheet such as polyethyleneterephthalate or polyvinylidene fluoride resin film or the like.

In the full-color image forming operation in the multi-color electrophotographic copying apparatus, the charger 2 and the image exposure means 3 are operated to form an electrostatic latent image on the outer surface of the photosensitive drum 1 by the light through a blue filter. The latent image is developed with the yellow developer contained in the developing device 4Y. On the other hand, the transfer material P supplied to the transfer drum 5 is caught by the gripper 5*c*, and contacts to the toner image formed on the outer surface of the photosensitive drum 1 together with the rotation of the transfer drum 5. The toner image is transferred onto the transfer material P by the operation of the transfer charger 5*b*, and simultaneously, the transfer material P is attracted to the transfer material carrying sheet 501.

The image formation and image transfer operation is repeated for the magenta, cyan and black colors. When the image formation and image transfer operations are completed onto the transfer material P for four colors, the transfer material P is discharged by the inside charger 5*d* and the outside charger 5*e*. Thereafter, it is separated from the transfer drum 5 and is discharged outside the apparatus through a sheet fixing roller 6. On the other hand, the residual toner remaining on the photosensitive drum 1 is moved by a cleaner 7, and the next image formation process is performed on the photosensitive drum 1.

The multi-color electrophotographic apparatus of the above-type operates in very good order. However, the inventors' experiments and investigations have revealed that problems arise particularly when the transfer material carrying sheet 501 of the transfer drum 5 is of polyvinylidene fluoride resin film or the like, and when the transfer material P is of paper, and when the humidity is high.

FIG. 5 shows the state of electric charge at the trailing edge Pa of the transfer material P at the following point of time. That is, a one color toner image has been transferred onto the transfer material P on the transfer drum 5; the toner image is on the transfer material P; the transfer material P has not yet been separated and is still wrapped around the transfer drum 5; and the transfer material is carried on the transfer drum 5 to receive the next toner image. The polarity of the image transfer voltage supplied to the transfer charger 5*b* is selected to be positive, when, for example, the latent image is constituted by the negative charge and when the developing toner is negatively charged for the reverse development.

The inventors' experiments and investigations have revealed that when the transfer material carrying sheet 501 of the transfer drum 5 is made of polyvinylidene fluoride resin film, and the transfer material P is composed of paper, the resin film having the volume resistivity of $110^{13}$ ohm.cm, and the transfer paper having a volume resistivity of $10^9$ (high humidity condition, 85%)–$10^{12}$ ohm.cm (low humidity condition, 10% ), then the positive charge supplied by the transfer charger 5*b* is injected into the transfer material P through the transfer material carrying sheet 501, and the positive charge is accumulated on the surface region of the transfer material P adjacent to the trailing end thereof Pa.

The positive charge accumulated on the surface region of the transfer material at the trailing edge Pa produces a strong electric field between the surface of the photosensitive drum. As shown in FIG. 6, when the trailing edge Pa of the transfer material is separated from the photosensitive drum 1, a separation discharge occurs to produce positive electric charge in the air, which is attracted by the positive charge of the transfer material P to the transfer material. The positive charge in the air moves to the photosensitive drum 1 which is negatively charged, with the result that damage is produced on the photosensitive drum 1 in the form of a stripe at the trailing edge of the transfer material P.

The charge memory on the photosensitive drum by the transfer charger described above sometimes can not completely be removed by uniform exposure means for exposing the entire surface of the photosensitive member to light, for example. This is particularly remarkable when the charging polarity of the photosensitive member is opposite to the polarity of the transfer charge. In addition, it is remarkable when the photosensitive member is an organic photoconductor. In the positive charging memory portion on the photosensitive drum, when the primary charger charges the photosensitive drum to a negative polarity to form the next image, the potential does not increase in the normal level, so that the charge level in the memory portion results in a stripe along the length of the photosensitive drum which has a lower potential, so that the photosensitive drum 1 is not uniformly charged. When the photosensitive drum is developed, a stripe appears.

Particularly when the length of the transfer material is longer than the circumferential peripheral length of the image bearing member, and when a multi-color image is to be formed, the stripe appears on the transfer material at the position away from the leading edge of the transfer material by $$2\pi(r-R)+L,$$

where r is a radius of the image bearing member, R is a radius of the transfer drum and L is a length of the transfer material.

The charge memory by the separation discharge is produced similarly at a position on the photosensitive drum adjacent to the leading edge of the transfer material, as well as the position corresponding to the trailing edge of the transfer material.

Particularly when the length of the transfer material is larger than the circumferential peripheral length of the image bearing member, the stripe or stripes appear at the position or positions corresponding to the circumferential length of the image bearing member from the leading edge of the transfer material

SUMMARY OF THE INVENTION

Accordingly, it is an object of the present invention to provide an image forming apparatus wherein the charge memory on the image bearing member is suppressed.

It is another object of the present invention to provide an image forming apparatus capable of producing high quality images by the suppression of the charge memory.

It is a further object of the present invention to provide an image forming apparatus wherein the suppression is imparted to the separation discharge, between the image bearing member and the transfer material, attributable to charge accumulation at the edge or edges of the transfer material supported on transfer material carrying means.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Referring to the accompanying drawings, the preferred embodiments of the present invention will be described in detail.

Figure 1:
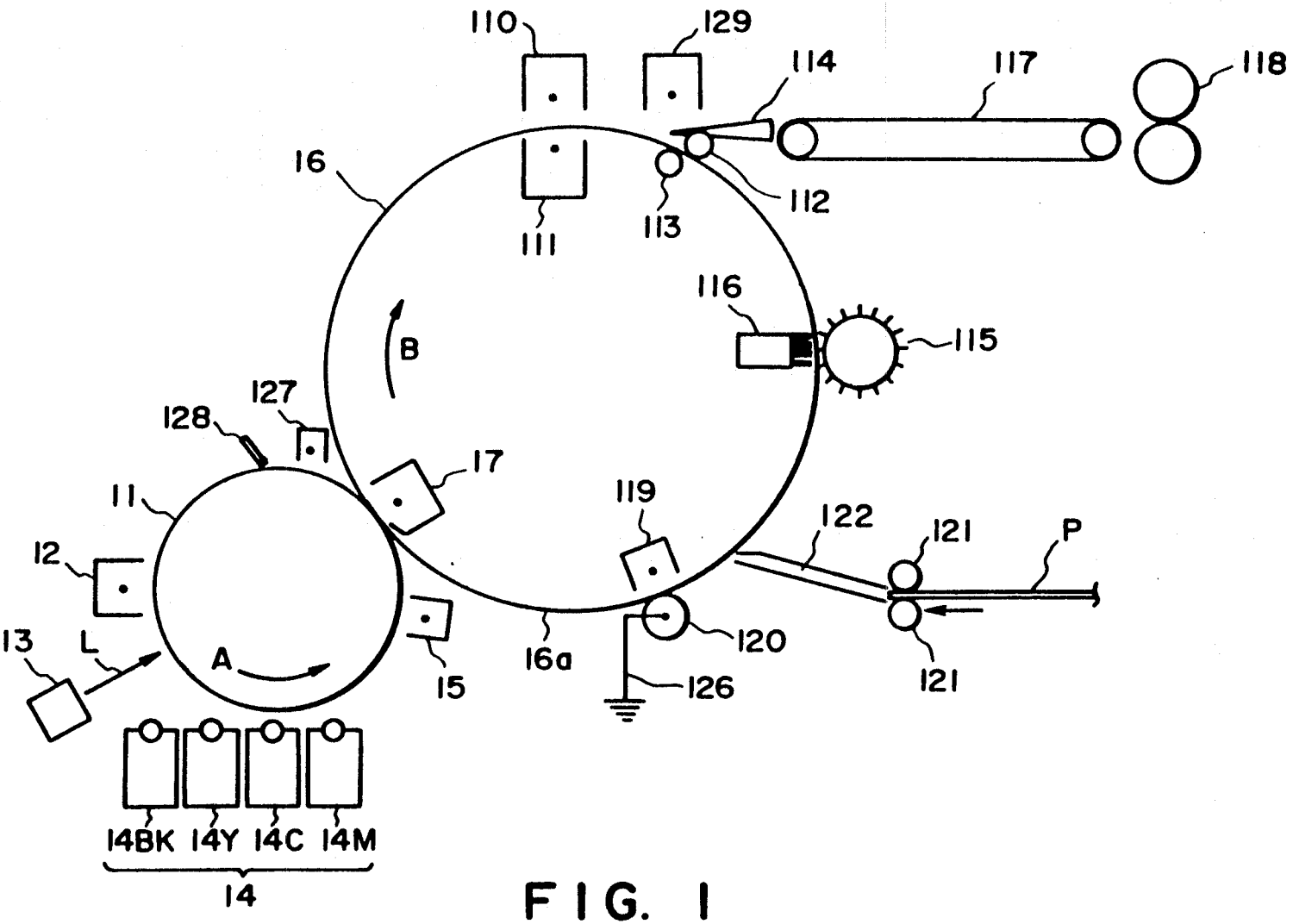
FIG. 1 is a sectional view of an image forming apparatus according to an embodiment of the present invention.

In FIG. 1, the image forming apparatus includes an image bearing member in the form of a photosensitive drum 11 made of an organic photoconductor having a negative charging property. The drum 11 is rotatably supported at its central axis for rotation in the direction indicated by an arrow A. The photosensitive drum has a diameter of 80 mm, and therefore, the circumferential peripheral length of the photosensitive drum is smaller than the maximum length of 420 mm (A3 size) of the transfer material measured in the conveyance direction thereof. Adjacent to the outer periphery of the photosensitive drum 11, there are disposed a primary charger 12, an optical system 13, a developer supplying device 14 and a secondary charger 15, in the order named, along the rotational direction thereof. The secondary charger 15 is optional. The primary charger 12 uniformly charges the photosensitive drum 11 to a voltage level Vd of −560 V. The optical system 13 supplies onto the surface of the charged photosensitive drum 11 a color separated light image or a light beam L corresponding to it at proper timing, by which the charged potential is attenuated down to a voltage level V1 = −120 V at the light-exposed portions, so that an electrostatic latent image is formed. The proper ranges for the voltage levels Vd and Vl are −300--900 V, and −50--200V, respectively. A laser beam exposure device is usable for the optical system 13. The developer supplying device 14 is of a movable type wherein it is movable in a tangential direction to face to the surface of the photosensitive drum 11. It includes four color developing devices 14M, 14C, 14Y and 14BK containing the four color developers, i.e., a magenta developer, a cyan developer, a yellow developer and black developer, respectively. In the developer supplying device, one of the developing devices selected corresponding to the color of the light image or the corresponding light beam L is brought to be presented before the photosensitive drum 11. It transfers the negatively charged toner to the photosensitive drum so as to deposit the toner particles on the portion of the photosensitive drum 11 surface where the light has been applied through the optical system 13. Thereafter, the toner image is charged by the secondary charger 15 to which the voltage of negative polarity is applied, by which the charge of the toner is enhanced.

Figure 4:
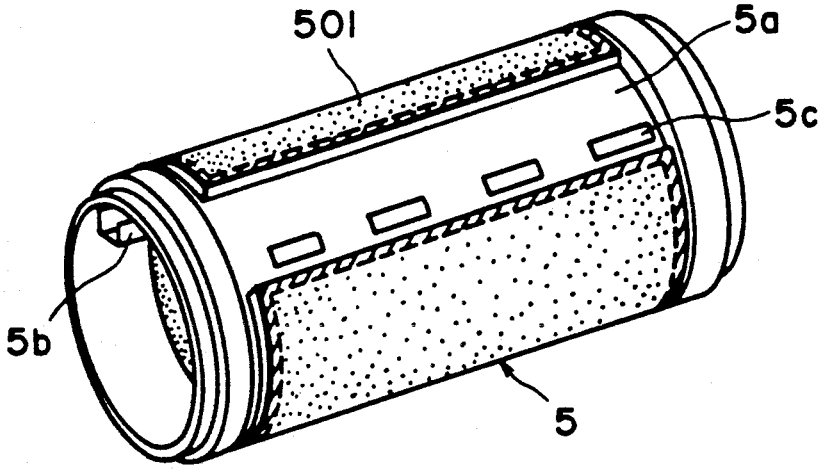
FIG. 4 is a perspective view of an image transfer device usable with the image forming apparatus of FIG. 3.

Downstream of the developing device for the reverse development with respect to the rotational direction of the photosensitive drum 11, an image transfer drum 16 having a diameter of 160 mm in the form of an endless drum or belt is disposed in contact with the surface of the photosensitive drum 11 or with a clearance smaller than the thickness of the transfer material P. As shown in FIG. 4, the transfer drum 16 has cylindrical opposite end frames and a cylindrical supporting or carrying sheet 16*a*. In this embodiment, there is no gripper for gripping the transfer material. The carrying sheet 16*a* is made of dielectric material, more particularly, polyvinylidene fluoride resin film having a thickness of 100–175 microns and a volume resistivity of $10^{13}$–$10^{15}$ ohm.cm. As for the carrying sheet, the one having the volume resistivity of not less than $10^{8}$ ohm.cm is usable.

Across the carrying sheet 16 from the photosensitive drum 11, an image transfer corona charger 17 is disposed to face the side of the carrying sheet 16*a* opposite from the transfer material carrying surface. The transfer drum 16 is rotated in the direction B. At a position upstream of the transfer drum 16 from the image transfer position where the photosensitive drum 11 and the transfer corona charger 17 are opposed, there are an attraction corona charger 119 at a side of the carrying sheet 16*a* opposite from the transfer material carrying surface, and a conductive roller 120 at the side opposite from the transfer material carrying side, opposed the attraction corona charger 119. Downstream of the transfer position with respect to the rotational direction of the transfer drum, corona dischargers 110 and 111 are disposed sandwiching the carrying sheet 16*a* to electrically discharge the transfer material to remove the transfer charge. Rollers 112 and 113 are disposed sandwiching the carrying sheet 16*a* to separate the transfer material P from the transfer material carrying sheet 16*a* (the detailed description will be made hereinafter). Adjacent to the rollers, there is a separation pawl 114. Further downstream thereof, there are a brush roller 115 to clean the carrying sheet by removing the toner or the like from the carrying surface and a corona discharger (not shown) or a discharger brush 116 to eliminate the deposition force such as the remaining coulomb force and the van der Vaals force.

The transfer material P now having the toner image is separated by the separation pawl 114 and is introduced by the conveyer 117 into an image fixing device having a fixing roller, where the toner image is fixed on the transfer material.

Upstream of the transfer position with respect to the movement direction of the transfer drum, the corona charger 119 and the conductive roller 120 are disposed sandwiching the carrying sheet 16*a*. *Immediately upstream thereof, there is a transfer material supplying means to supply the transfer material P to the supporting surface of the carrying sheet 16a* through registration rollers 121 and 121 along a guide 122.

Reference numerals 127 and 128 designate a discharger for removing the electrostatic charge from the surface of the photosensitive drum 11 and a cleaning blade 128 for removing the toner. Adjacent to the separation pawl 114, a corona discharger 129 is disposed to prevent disturbance of the image attributable to a separation discharge which an occur upon separation of the transfer material P from the carrying sheet 16*a*. The corona discharger 129 is an AC corona discharger.

In operation, the surface of the photosensitive drum 11 is uniformly charged by the primary charger 12 and is exposed to a color light image through a green filter at first. By this, a latent image corresponding to the magenta component is formed. In synchronism with the formation of the latent image, the developer supplying device 14 moves the developing device 14M containing the magenta developer in the tangential direction toward the photosensitive drum 11 to present it adjacent the photosensitive drum, and therefore, the latent image receives the toner particles electrostatically transferred to form a magenta image on the photosensitive drum 11.

On the other hand, the transfer material P is introduced to the guide 122 by the registration rollers 21 and 121, and it is further supplied to the position of the conductive roller 120 along the surface of the carrying sheet 16*a*. Here, the transfer material P is electrostatically attracted on the carrying sheet 16*a* by the corona charger 119 and is introduced into the transfer position. At this time, the operational timing of the registration rollers 121 and 121 and the latent image formation timing of the optical system 13 are synchronized, so that the toner image on the photosensitive drum 11 and the transfer material P are faced or contacted at the transfer position. At the transfer position, the corona charger 17 for the image transfer is operated to produce an image transfer electric field, by which the positive electric charge on the carrying sheet 16*a* attracts the toner from the transfer drum 11 to the transfer material P. The toner remaining on the photosensitive drum 11 is subjected to the electric charging operation by the discharger 127, and thereafter, is removed by the blade 128, so that the surface of the photosensitive drum 11 is cleaned.

The transfer material P supported on the carrying sheet 16*a* keeps carrying the toner image, and rotates by the rotation of the drum 16 to pass between the corona dischargers 110 and 111. At this time, the corona dischargers 110 and 111 are not energized. The rollers 112 and 113 are also away from the carrying sheet 16*a*. In addition, the brush roller 115 and the corona discharger (not shown) or the brush discharger 116, and the conductive roller 120 are all away from the carrying sheet 16*a*, and therefore, they do not disturb the toner image on the transfer material P by the coulomb force, when the transfer material is supplied again to the transfer position between the corona charger 119 and the conductive roller 120. The voltage application to the corona charger 119 for attracting the transfer material P onto the transfer drum 16 and the contact of the conductive roller 120 to the transfer material P have been completed before the leading of the toner image on the transfer material P reaches the positions of the corona charger 119 and the conductive roller 120.

When it passes between them, the electric charge for the attraction is not supplied to the transfer material P. Before the leading edge of the toner image on the transfer material reaches the transfer position, the magenta image is formed on the photosensitive drum 11, and in addition, the optical system 13 supplies the color image through the red filter onto the photosensitive drum 11. The developer supplying device 14 shifts the developing devices to present the developing 14c before the photosensitive drum 11. It supplies the cyan toner to form a cyan image on the photosensitive drum 11. Accordingly, at the transfer position, the cyan developer on the photosensitive drum 11 is transferred on the toner image of the magenta developer on the transfer material P carried on the transfer drum.

In this manner, the optical system sequentially uses the green filter, red filter and the blue filter to form on the photosensitive drum 1 color-separated latent images of the same image, and the developer supplying device 14 sequentially supplies the corresponding developers, i.e., the magenta developer, the cyan developer and the yellow developer. The toner images are sequentially transferred onto the same transfer material P supported on the transfer drum. As a whole, a color image is formed. The order of the filter selections and the corresponding selection of the developers may be determined as desired.

After the last toner image, that is, the yellow developer image in this embodiment, is transferred onto the transfer material P, the corona dischargers 110 and 111 are energized when the transfer material P passes therebetween to electrically discharge the transfer material P, and the rollers 112 and 113 are pressed to the transfer material carrying sheet 16a, by which the curvature of the carrying sheet 16a is increased to assist the separation of the transfer material P from the carrying sheet 16a. The separation pawl 114 is contacted to or brought close to the carrying sheet 16a to separate the leading edge of the transfer material P from the carrying sheet 16a. The transfer material P is supplied by the conveyer 117 to the fixing roller 118, where the toner images are fused, and therefore, the colors thereof are mixed. Then, they are superposedly fixed. At the time of the transfer material separation, the possibility of the image disturbance by the separation discharge may preferably be prevented by the corona discharger 129.

In this manner, a color image can be copied or formed. When the optical system 13 does not use the color filters, and the developing device 14 supplies the black developer by the developing device 14BK, a usual black and white image is produced. In this case, only one image transfer operation is carried out, and therefore, after the image transfer operation, the elements operated at the time of the last image transfer in the color image formation are operated.

At the final stage of the image formation, a black image formed by white image exposure can be superposedly transferred.

Figure 2:
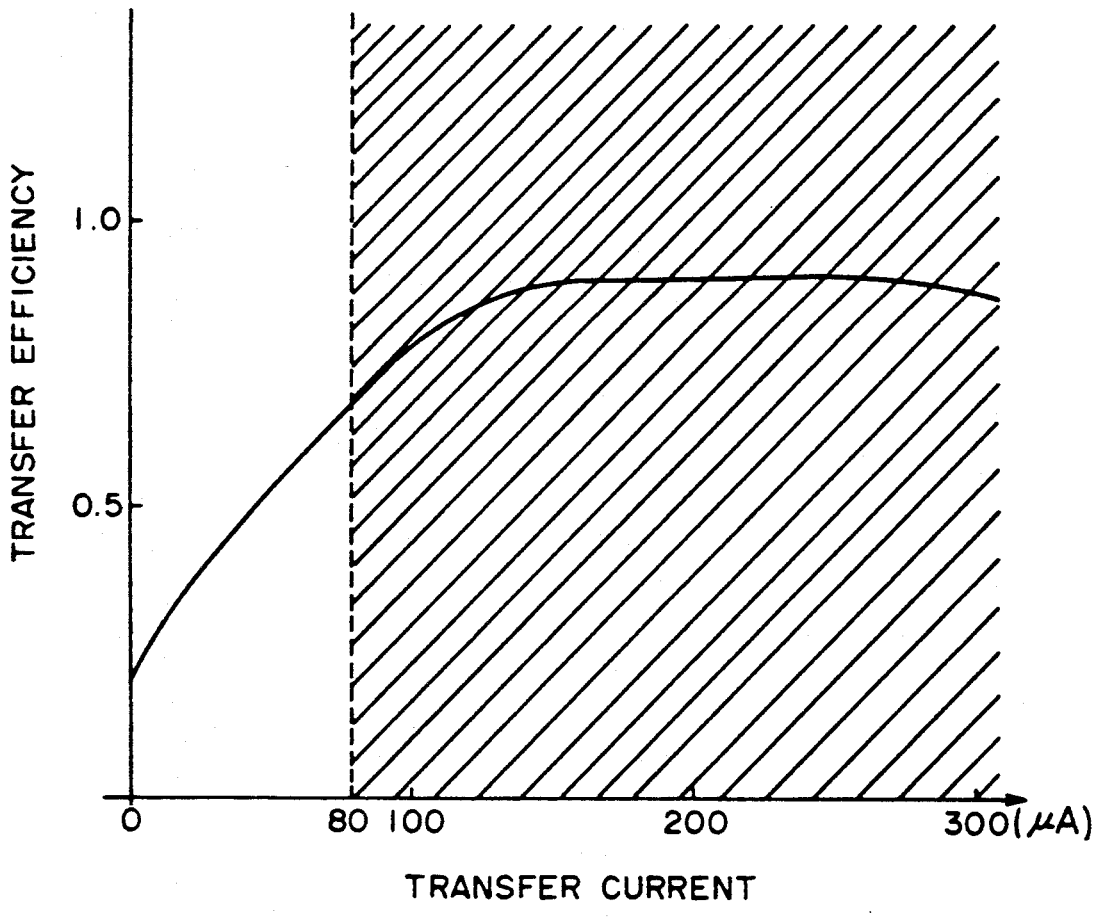
FIG. 2 is a graph illustrating a relation between an image transfer current and an image transfer efficiency or production of a lateral stripe on the transfer material.

Referring to FIG. 2, there is shown a relationship between a first color image transfer output current I1 to the wire electrode of the transfer corona discharger and the first color image transfer efficiency (toner weight on the transfer material after the image transfer divided by the weight of the toner on the photosensitive member before the image transfer). Also, the region where the lateral stripe is produced is shown by the hatching lines in the same figure. The production of the lateral stripe, as described hereinbefore, stems from the charge memory on the photosensitive drum by the separation discharge by the separation between the transfer material P on the transfer drum and the photosensitive drum. In FIG. 2, the production of the lateral stripe is investigated by the electric charge is uniformly given by the transfer corona discharge to the whole surface of the transfer material P (including the longitudinal edges of the transfer material), and the image on the transfer material P is investigated.

As will be understood from FIG. 2, the production of the lateral stripe increases with an increase of the transfer current, and therefore, increases the transfer efficiency to stabilize the transfer (the transfer efficiency of approximately 0.8). With the current (not more than 80 microamperes) not producing the lateral stripe, the transfer efficiency is small with the result of unstable image transfer operation.

In the present invention, the transfer current is decreased adjacent to an edge or edges in the direction of the transfer drum movement to prevent or suppress the lateral stripe, while the transfer current sufficient to stabilize the image transfer is supplied in the other image region on the transfer material.

Figure 7:
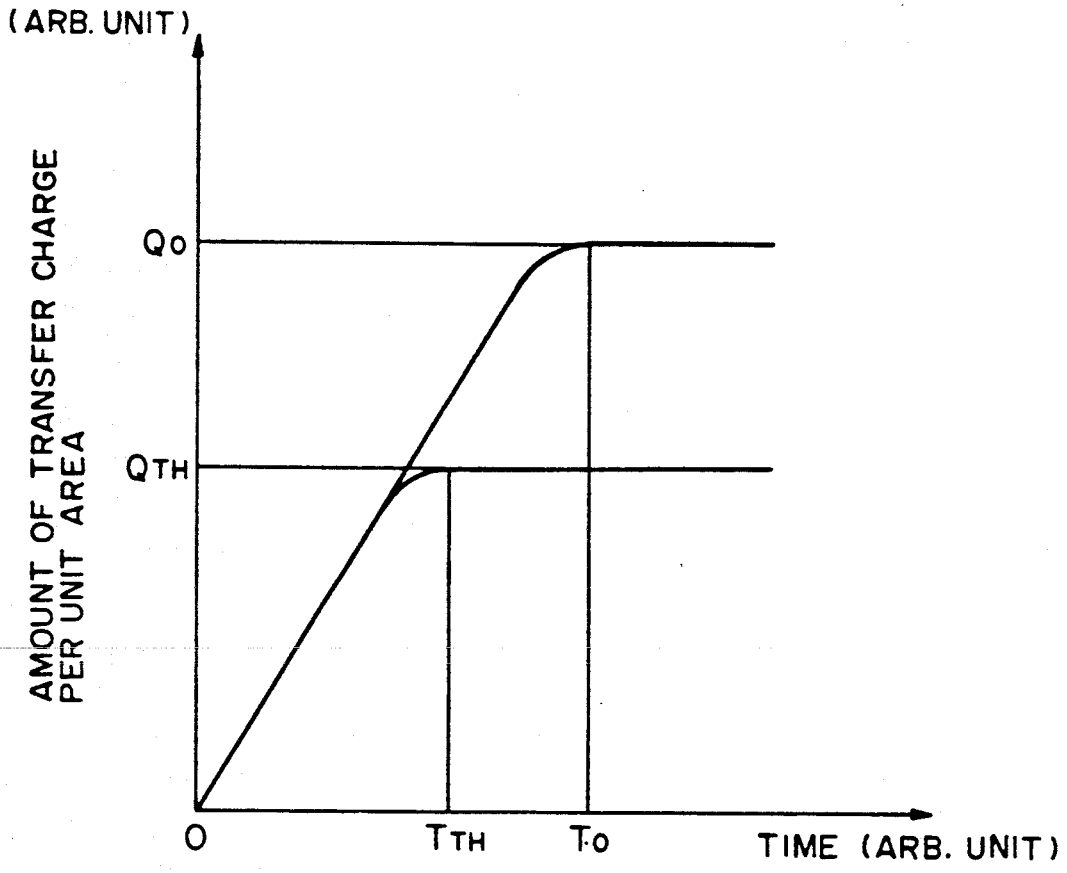
FIG. 7 illustrates the raising period of the transfer charge amount received by the carrying sheet.

When the transfer corona discharger is switched from the non-operative state to the operative state, by switching its output, the transfer charge amount, that is, the transfer current per unit area of the transfer material or the carrying sheet as a rising characteristic shown in FIG. 7. This characteristic depends on the rising characteristics of the power source for the transfer corona discharger. It is assumed that To is a rising time until the transfer charge amount Qo providing the stabilized transfer efficiency, and $T_{TH}$ is a rising time until the transfer charge amount $Q_{TH}$ result in the production of the lateral stripe is reached. The charge amount supplied by the transfer corona discharger on a unit area of the transfer material is measured by detecting the current or voltage supplied from the power source to the transfer corona discharger.

Further assuming that x is a distance from an edge of the transfer material and an edge on the transfer material from which the image is formed (non-image-formation area), $$x \geqq (To - T_{TH})\ Vps$$

where Vps is a process speed, that is, the peripheral speed of the photosensitive drum.

That is, by feeding the transfer material so that the leading edge thereof reaches the transfer position by the time $T_{TH}$ counted from the start of the operation of the transfer corona discharger, the leading edge of the transfer material is given the transfer charge not resulting in the lateral stripe production at the leading edge portion. By feeding it so that the leading edge of the image on the transfer material reaches the transfer position after the time period To counted from the start of the operation, the leading edge portion of the image on the transfer material is given the transfer charge sufficient to stabilize the transfer efficiency. When $X \geqq ToVps$, it is possible that the operation of the transfer corona discharge is started after the leading edge of the transfer material reaches the transfer position.

In this manner, the non-image-formation region where the toner image is not formed is provided adjacent to the leading edge of the transfer material, and within the region, the transfer corona discharger is started up from the charge amount not resulting in the production of the lateral stripe on the transfer material to the charge amount sufficient to stabilize the transfer efficiency.

In the region of the photosensitive drum corresponding to the non-image-formation area adjacent the leading edge of the transfer material, the toner image is not formed.

The lateral stripe tends to occur particularly under high humidity conditions. Under a high humidity condition, the electric resistance of the transfer material and that of the carrying sheet are decreased, and therefore, the transfer current and the discharging current discharged by the discharger 11 interfere with each other. The discharging current may be an AC current or a DC current having a polarity opposite to that of the transfer current, or the one provided by superposing them.

Figure 8:
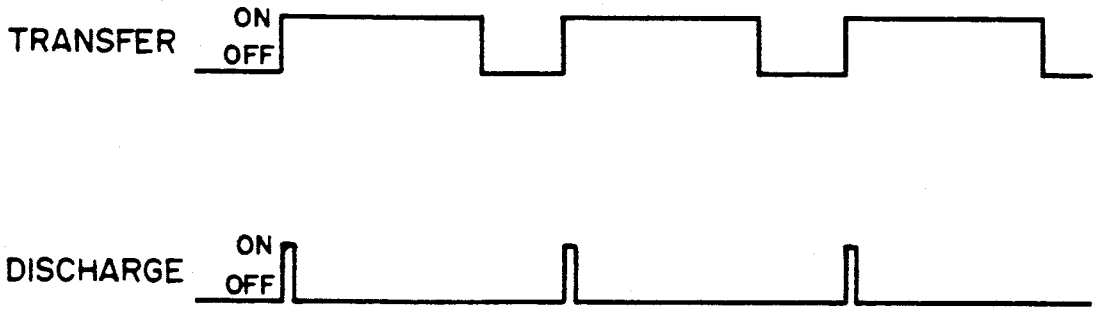
FIG. 8 is a timing chart of an image forming apparatus according to an embodiment of the present invention.

FIG. 8 is an example of a timing chart for the transfer current and the discharging current. The discharging current is rendered ON when the leading edge of the transfer material is substantially at the transfer position where the photosensitive drum and the transfer corona discharger are opposed, but it is in off-state when the other area, that is, the image area of the transfer material is at the transfer position. By doing so, the transfer current at the transfer material leading edge is reduced, whereas the transfer current in the image area is proper.

Figure 9:
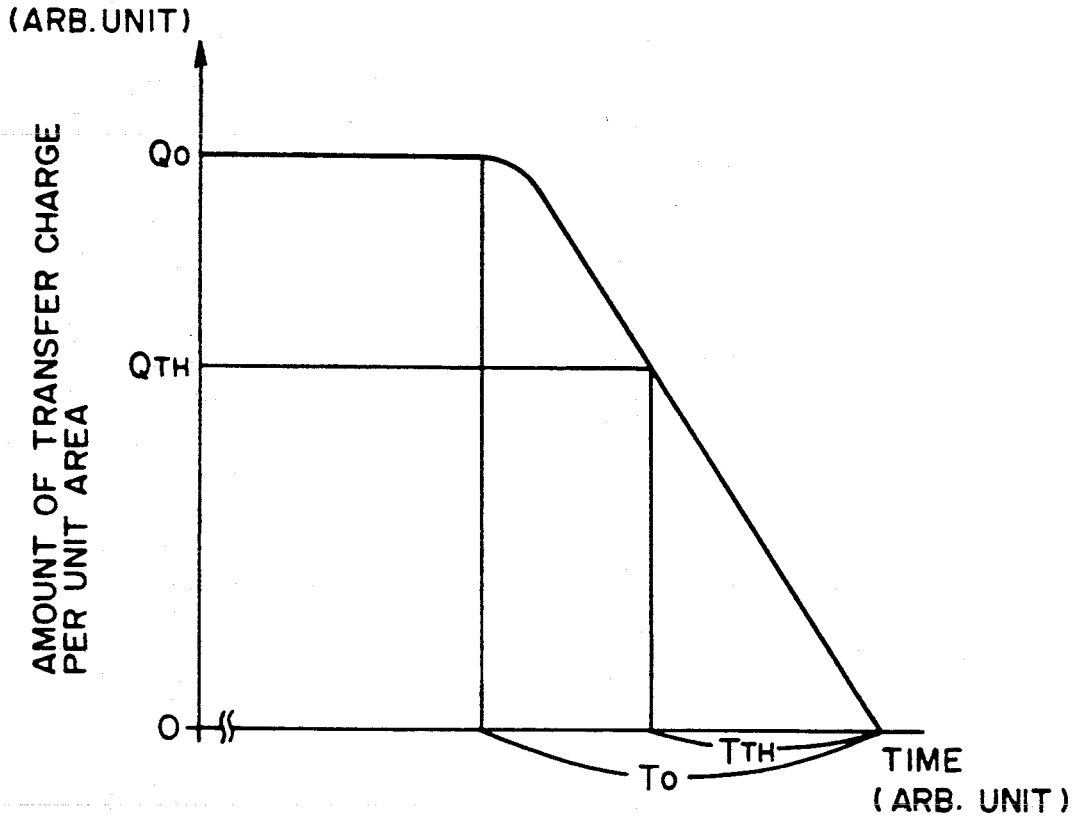
FIG. 9 illustrates the lowering period of the transfer charge amount received by the carrying sheet.

The output of the transfer corona discharger is switched from the operating position to the non-operating position, the transfer charge amount, that is, the transfer current per unit area of the transfer material or the carrying sheet exhibits the falling characteristics as shown in FIG. 9 (opposite to that shown in FIG. 7). It is assumed that To is the falling time from the transfer charge amount Qo stabilizing the transfer efficiency to zero transfer charge amount, and that $T_{TH}$ is the falling time from the transfer charge amount $Q_{TH}$ resulting in the transfer charge amount resulting in the production of the lateral stripe to the zero transfer charge amount.

Further assuming that x is a distance between the trailing edge of the transfer material and the trailing edge of the image formed on the transfer material (non-image-formation area), $x \geqq (To - T_{TH})Vps$.

That is, when the trailing edge of the image on the transfer material is at the transfer position, the transfer charge sufficient to stabilize the transfer efficiency is supplied to the transfer material by the transfer corona discharger, and the trailing edge of the transfer material reaches the transfer position ($To - T_{TH}$) period thereafter, by which the trailing edge of the transfer material is supplied with the transfer charge not resulting in the production of the lateral stripe (including zero transfer charge amount), and then, the operation of the transfer corona discharger is stopped.

In this manner, the non-image-formation area where the toner image is not produced is provided adjacent the trailing edge of the transfer material, and within the region, the charge amount for this area is lowered from the charge amount stabilizing the transfer efficiency to the charge amount not producing the lateral stripe.

In the region on the photosensitive drum corresponding to the on-image-forming region adjacent the transfer material, the toner image is not produced.

The lateral stripe tends to occur under the high humidity conditions. Under the high humidity conditions, the electric resistances of the transfer material and the carrying sheet are small, and therefore, the transfer current and the discharge current by the discharger 11 interfered with each other. The discharge current is an AC current or a DC current having a polarity opposite to the transfer current or the one provided by superposing them.

Figure 10:
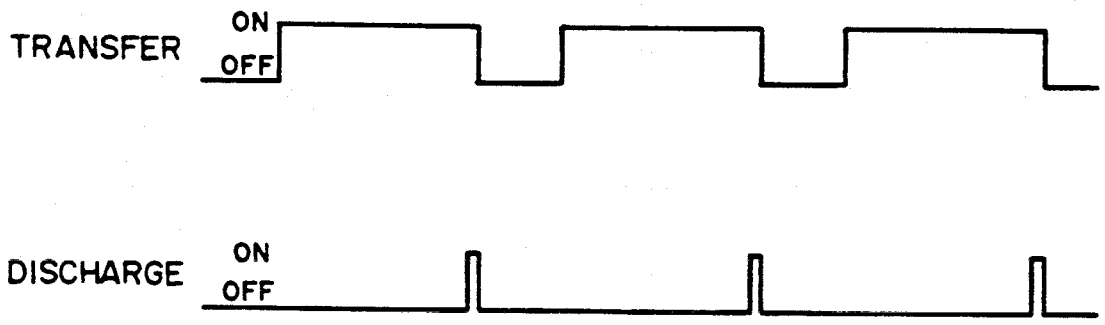
FIG. 10 shows a timing chart applicable to the image forming apparatus according to an embodiment of the present invention.

FIG. 10 shows an example of a timing chart of the transfer current and the discharging current.

The discharge current is in ON-state when the trailing edge of the transfer material is at the transfer position where the photosensitive drum and the transfer corona discharger are substantially opposed, whereas it is in OFF-state when the other area, that is, the image area on the transfer material is at the transfer position. By doing so, the transfer current is weakened adjacent to the transfer material trailing edge, whereas in the image region, the transfer current is maintained at the proper level.

The transfer current is set to be 10014 200 micro-ampere when the image area of the transfer material is at the transfer position for the first color component image. The values of Qo, $Q_{TH}$, x, Vps and ($To - T_{TH}$), are set to be $2.9 \times 10^{-6}$ C/cm$^2$, $3.2 \times 10^{-7}$ C/cm$^2$, 2 mm, 84 mm/sec and 30 msec. The non-image-formation region x at the edges of the transfer material is preferably 2–5 mm. The discharge current is preferably −50 micro-ampere when the DC current is used. When an AC current is used, the difference between the polarity components is preferably −50 micro-ampere.

As for the transfer current in the second and subsequent color image transfer, the fundamental timing of the transfer corona charger operation is similar to the case of the first color image transfer. However, since the relation between the transfer current and the transfer efficiency changes (usually, the proper current range shifts to the larger current side, that is, the right hand side because the transfer sheet has been charged), the current level not resulting in the lateral stripe and the current level stabilizing the transfer efficiency also change. In view of this, the transfer current for the image region of the transfer material is preferably sequentially increased with the superposition of the toner image on the transfer material. In this embodiment, the output of the power source connected to the transfer corona discharger provides a constant current, but it may provide a constant voltage.

In the foregoing embodiment, when the photosensitive drum and the transfer material are contacted (transfer step) to transfer the toner image from the photosensitive drum to the transfer material supported on the transfer material, the charge amount supplied to the edge by the transfer corona discharger is controlled so that the charge amount supplied to the edge portions of the transfer material by the transfer corona discharger is different from the charge amount supplied to the other portion of the transfer material. The invention is not limited to this and another embodiment will be described.

Where, for example, the peripheral circumferential length of the transfer drum is substantially equal to the length of the transfer material measured in a direction of the transfer drum movement, then after the first color image transfer operation is completed with the one full-rotation of the transfer drum, the next image formation on the photosensitive drum is not completed (the movements of the optical system and/or the developing device, for example, are not completed for the next image formation start), before the start of the next transfer drum rotation. In that case, the transfer drum is allowed to be rotated idly by one full rotation, and the image transfer is performed with the subsequent rotation of the transfer drum, as the case may be. That is, the transfer drum rotates one full turn for the image transfer step and one full idle turn, and therefore, in order to complete the four color image transfer, three idle rotations are required at a minimum.

Adding the idle rotation, the transfer material supported on the carrying sheet has the already transferred toner image, and therefore, the toner can offset from the toner image on the transfer material to the photosensitive drum surface to disturb the toner image on the transfer material. To avoid this, that is, to retain the toner image on the transfer material, the transfer corona discharger is supplied with a voltage having a positive polarity which is the opposite to the polarity of the toner. At this time, the transfer material P supported on the carrying sheet contacts to the non-image-region, more particularly, to the region on the photosensitive drum surface where the latent image is not formed.

In this embodiment, the charge amount by the transfer corona discharger is controlled so that the charge amount supplied to the edge portion of the transfer material is different from the charge amount supplied to the other portion of the transfer material, during the idle rotation. A more detailed description will now be provided.

Figure 3:
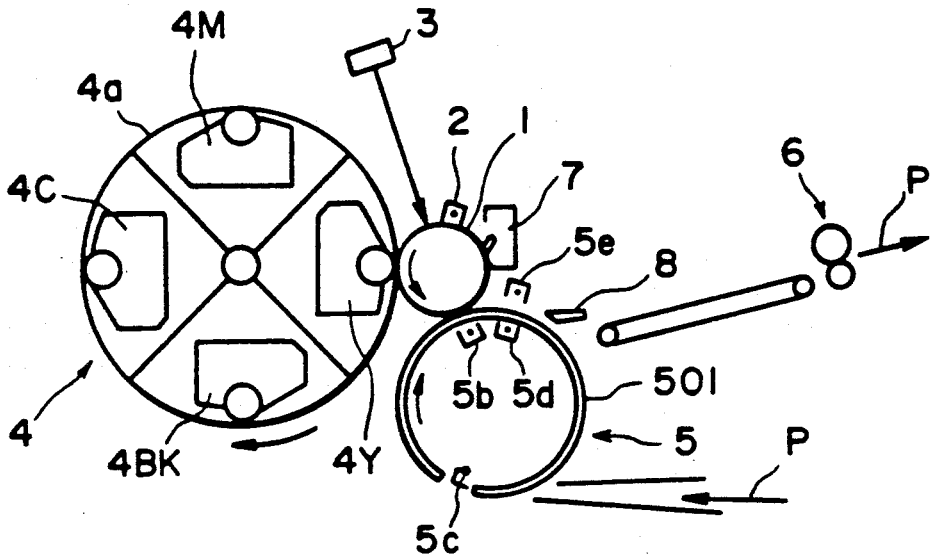
FIG. 3 is a sectional view of a multi-color electrophotographic apparatus to which the present invention is applicable.

This embodiment is particularly usable with the multi-color electrophotographic apparatus having the rotary type developing device shown in FIG. 3. Therefore, the present invention is incorporated in the multi-color electrophotographic apparatus of FIG. 3. The fundamental structure and operation are the same as described hereinbefore. The photosensitive drum 1 has a diameter of 80 mm, and the transfer drum 5b has a diameter of 160 mm (twice the diameter of the photosensitive drum).

The photosensitive drum 1 is rotated in the direction of an arrow at the peripheral speed of 160 mm/sec. During the rotation, it is uniformly charged by the primary charger 2 to −300−−900 V. Each of the developing devices of the rotary type developing apparatus 4 contains different color toner charged to a negative polarity, and the latent image on the photosensitive drum 1 is visualized through reverse development.

The visualized image, that is, the toner image on the photosensitive drum 1 is transferred onto the transfer material P supplied to the transfer device 5. In this embodiment, the image transfer device 5 has the same structure described hereinbefore in conjunction with FIGS. 3 and 4. More particularly, the transfer drum 5 is supported for rotation and includes a cylinder 5a on which the transfer material carrying sheet 501 is stretched, a transfer corona charger 5b in transfer material gripper 5c for gripping the transfer material P supplied from the sheet feeding device (not shown). To the inside and outside of the transfer drum, an inside discharger 5d and an outside discharger 5e constituting the discharging means are disposed.

The transfer material carrying sheet 501 is made of polyvinylidene fluoride resin film having a thickness of 100–175 microns and a volume resistivity of $10^{13}$.

The transfer charger 5b is in the form of a corona charger, and is supplied with +5 KV−30 9 KV, for example. The transfer current is +100 micro-ampere−+500 micro-ampere.

Figure 11:
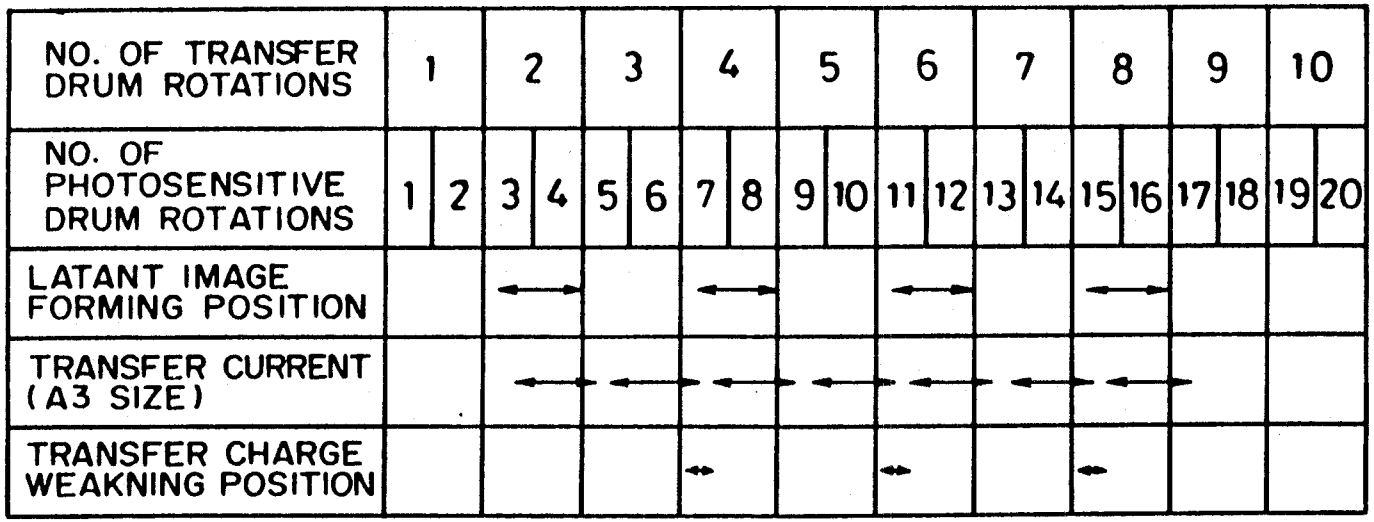
FIG. 11 shows the image transfer operation sequence relative to the number of rotations of the photosensitive drum and the transfer drum in an image forming apparatus of this invention.

FIG. 11 shows the operational sequence of the image forming apparatus. As shown in this Figure, the transfer charger 5b is operated during the image forming and image transfer operations, more particularly, during the transfer material P being contacted to the toner image formed on the outer surface of the photosensitive drum 1 (the positions corresponding to the numbers of the drum rotations 2, 4, 6 and 8), during the idle rotation period, that is, after the completion of the image forming and transfer operations and before the next color image forming operation is started with the condition that the transfer material P contacts to the area of the outer surface of the photosensitive drum 1 where the electrostatic latent image is not formed (the positions corresponding to the numbers of the transfer drum rotations 3, 5 and 7).

According to this embodiment, when the transfer material P contacts the non-image area of the photosensitive drum 1, the electric discharge action of the transfer charger 5b is weakened during the trailing edge Pa of the transfer material P is contacted to the transfer drum 1 at the contact position where the transfer charger 5b is disposed. By doing so, the transfer current is made smaller than the normal image transfer operation period. For example, the current is +20−+100 micro-ampere which is one fifth of the normal transfer current which is +100−+500 micro-ampere. During the idle rotation, the previous developing device is moved away from the photosensitive member, and the next developing device is presented to the photosensitive member.

In the image forming apparatus of this embodiment wherein the multi-color image is formed by the four color image forming process, the transfer current is weakened when the trailing edge portion Pa of the transfer material P is contacted to such a portion of the photosensitive drum 1 where the electrostatic latent image is not formed during the periods after the yellow image, the magenta image and the cyan image are formed and are transferred onto the transfer material P, and before the next images, i.e., the magenta image, the cyan image and the black images are started to be formed, respectively.

Figure 5:
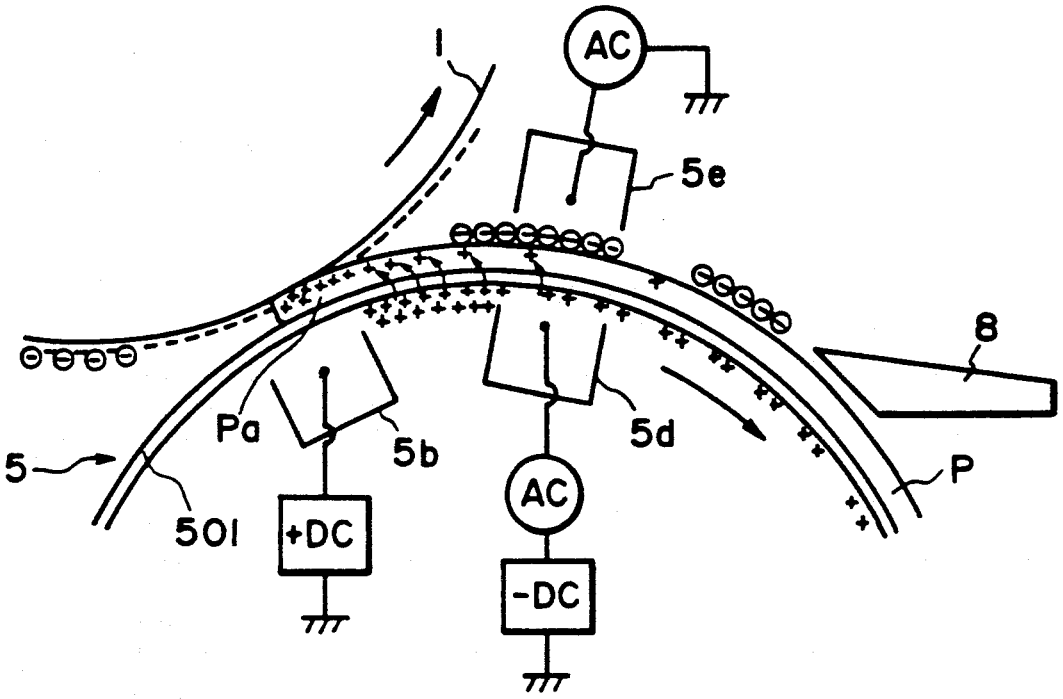
FIGS. 5 and 6 illustrate charge movement upon the image transfer operation to the transfer material in a conventional image forming apparatus.
Figure 6:
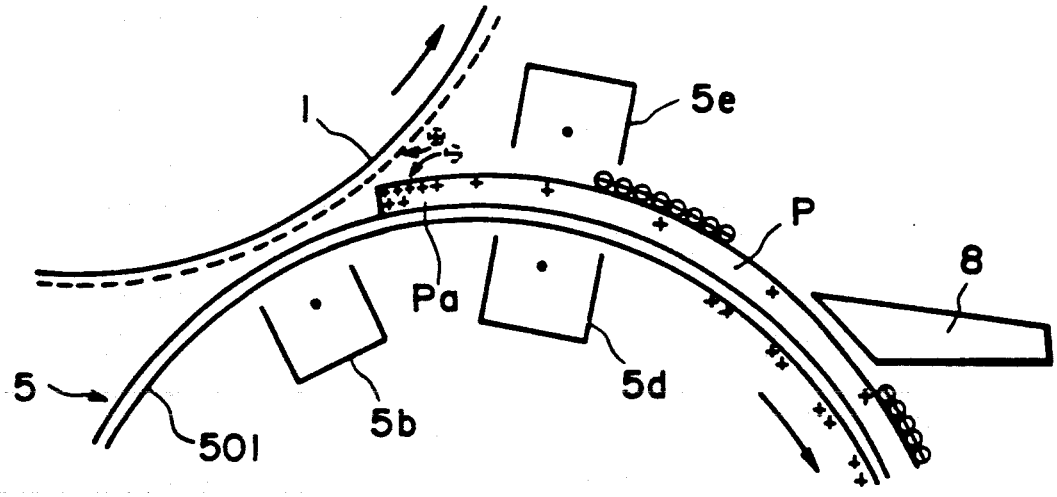

According to this embodiment of the present invention, the positive charge injected from the transfer charger into the transfer material P through the transfer material carrying sheet and accumulated in the surface region Pa corresponding to the trailing edge of the transfer material P is significantly reduced. Therefore, the conventional high voltage electric field is not produced between the surface of the photosensitive drum and the surface region corresponding to the trailing edge of the transfer material. Accordingly, as shown in FIG. 5, when the trailing end portion Pa of the transfer material is separated from the photosensitive drum 1, the separation discharge does not occur, so that the damage, that is, the memory on the photosensitive drum 1 resulting from the positive charge in the air moves to the photosensitive drum 1 negatively charged is not prevented.

In this embodiment, in the transfer material trailing edge portion Pa contacted to the non-image-formation region of the photosensitive member 1, the transfer current by the transfer charger 5b is weakened, but the present invention is not limited to this embodiment. The present invention includes:

(1) the operation of the transfer charger 5b is stopped adjacent the transfer material trailing edge Pa contacting the non-image-formation region of the photosensitive member 1; and (2) the transfer current by the transfer charger 5b is made opposite from that during the transfer operation adjacent the transfer material trailing edge Pa contacting the non-image-formation region of the photosensitive member 1 (the transfer current level at this time may be larger than the level of the transfer current having the same polarity opposite polarity from the toner charge polarity) supplied outside the edge portions of the transfer material.

FIG. 11 is a modification of the foregoing embodiment. More particularly, the charge amount supplied to the edge portions by the transfer corona discharger during the transfer process is made smaller than the charge amount supplied during the other period. When this is done, in FIG. 11, the transfer current is weakened when the trailing portion of the transfer material is contacted to the photosensitive drum during the transfer process (the positions corresponding to the numbers of the transfer drum rotations 2, 4, 6 and 8).

Figure 12:
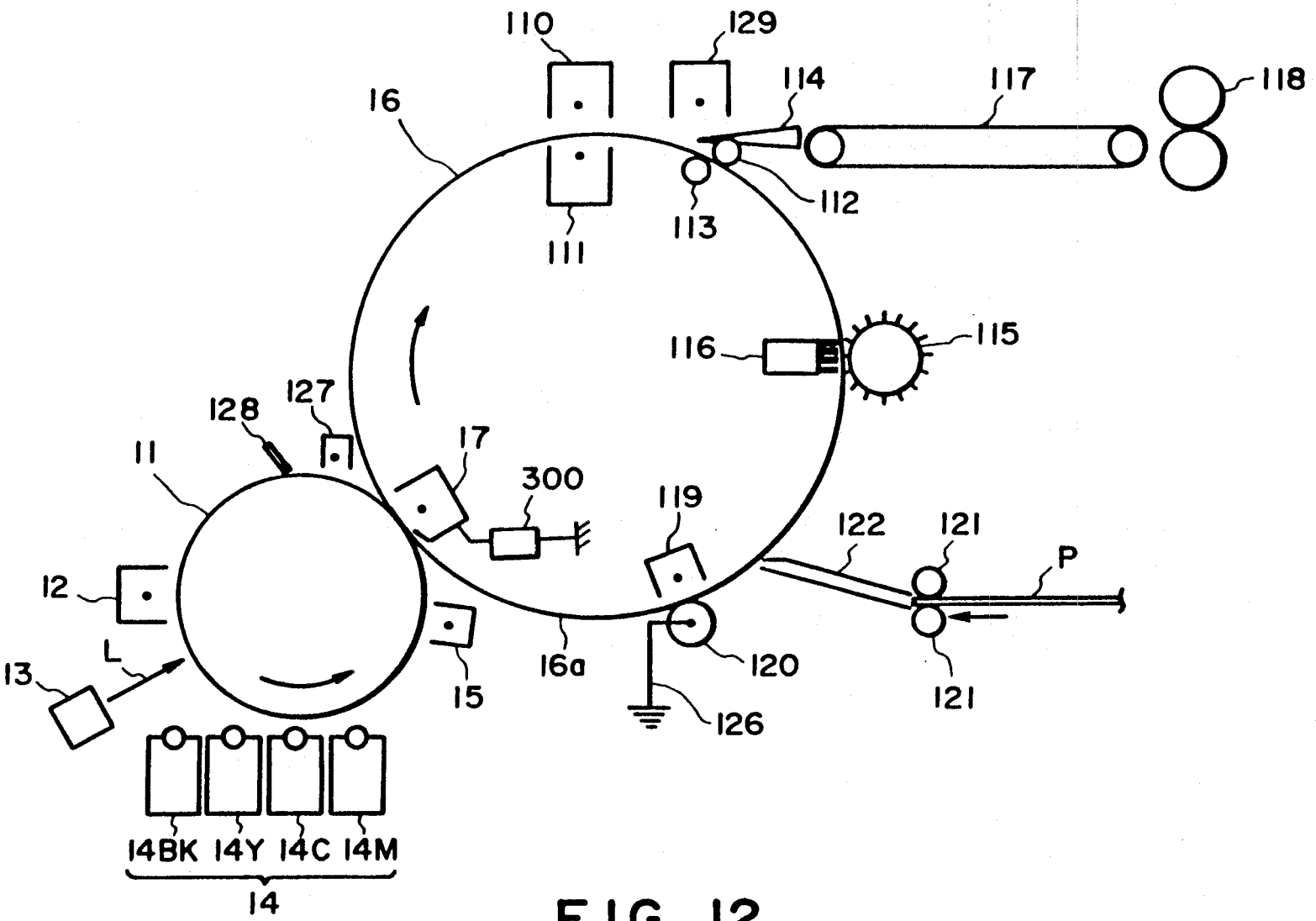
FIG. 12 is a sectional view of a multi-color electrophotographic apparatus to which the present invention is applicable.

FIG. 12 shows a further embodiment, wherein the entirety or part of a shield plate electrode enclosing the wire electrode of the transfer corona discharger is electrically isolated and is connected with a constant voltage source 300. When the leading edge of the transfer material is at or moved to the transfer position, a voltage having a opposite polarity to the transfer current is applied to the shield plate, and when the image region on the transfer material is at the transfer position, the potential of the shield plate is made zero. By doing so, the transfer current at the transfer material leading and/or the trailing edge is weakened, whereas in the image region, the transfer current is maintained at the proper level.

In the foregoing embodiments, a description has been provided with respect to the case of the reverse development in which the transfer memory tends to occur, since it is particularly effective in the reverse development. However, the present invention is applicable to the regular development wherein the development is effected with the toner having the polarity opposite to the charging polarity of the photosensitive member.

The charge memory of the photosensitive member easily occurs at the position corresponding to the trailing edge later than the leading edge of the transfer material, according to the results of experiments made by the inventors. Therefore, it is effective only to control the transfer corona discharger so that the charge amount supplied to the trailing edge of the transfer material is made different from the charge amount to the other portion. However, it is preferable that this is done at each of the leading and trailing edge portions.

A charging roller is usable in place of the transfer corona discharger. By doing so, the voltage applied to the roller can be reduced, and therefore, the ozone production can be remarkably reduced.

In place of the transfer drum, a transfer belt having a dielectric surface is usable.

In the foregoing embodiment, the means for controlling the switching timing between the operation and non-operation of the transfer corona discharger in this embodiment may include levers disposed at the operating position of the apparatus. In this manner, in association with the operation of the lever, in order to change the timing of the voltage applied to the transfer corona discharger in response to the operations of the lever, a relay circuit may be used in the power source.

The image bearing member described in the foregoing as the photosensitive member may be an insulative member when a latent image is formed on the insulative member by a multi-stylus device.

As described in the foregoing, according to the present invention, the charge amount received by the edge portion or portions of the transfer material is made different from the charge amount received by the image formation region of the transfer material, and therefore, the lateral stripe is prevented, and simultaneously, the transfer efficiency is maintained high. Also, a high quality image can be provided.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

a movable image bearing member;

image forming means for forming a toner image on said image bearing member;

transfer means for electrostatically transferring the toner image from said image bearing member onto a transfer material at an image transfer position;

transfer material carrying means for carrying the transfer material to the transfer position;

wherein said transfer means supplies different electric charge amounts per unit area to an end portion of the transfer material in a direction of conveyance of the transfer material by said transfer material carrying means and to another portion of the transfer material, wherein said transfer material carrying means has a carrying surface made of dielectric material.

2. An apparatus according to claim 1, wherein said transfer means supplies the different amounts of electric charge during an image transfer operation to the transfer material.

3. An apparatus according to claim 1, wherein said transfer means supplies the different amounts of electric charge when the transfer material having a toner image is at the transfer position not for transferring another toner image onto the transfer material.

4. An apparatus according to claim 1, wherein the end portion is a leading end portion of the transfer material in a conveyance direction of said transfer material carrying means.

5. An apparatus according to claim 1, wherein the end portion is a trailing end portion of the transfer material in a conveyance direction of said transfer material carrying means.

6. An apparatus according to claim 1, wherein a peripheral length of said image bearing member measured in a direction of its movement is smaller than a maximum length of the transfer material measured in a conveyance direction of said transfer material carrying means.

7. An apparatus according to claim 1, wherein said image forming mean includes latent image forming means for forming a latent image on said image bearing member and developing means for developing the latent image with toner.

8. An apparatus according to claim 7, wherein said transfer means has a charging polarity which is opposite to a polarity of the latent image.

9. An apparatus according to claim 8, wherein said image bearing member is a photosensitive member, and said latent image forming means includes exposure means for exposing the photosensitive member in accordance with the image information.

10. An apparatus according to claim 9, wherein said photosensitive member has a layer made of organic photoconductive.

11. An apparatus according to claim 1, further comprising discharge means having a polarity opposite to that of said transfer means, and disposed opposed to said transfer material carrying means downstream of said transfer material carrying means in a direction of conveyance of the transfer material.

12. An apparatus according to claim 11, wherein said discharging means applies electric discharge to the transfer material carried on said transfer material carrying means when the end portion of the transfer material is at the transfer position.

13. An apparatus according to claim 13, wherein said discharging means discharges a larger amount of electric discharge when the end portion of the transfer material is at the transfer position than when another portion of the transfer material is at the transfer position.

14. An apparatus according to claim 2, wherein when said transfer means effects its transfer operation onto the transfer material, the end portion of the transfer material is contacted to a portion of said image bearing member where no image is formed.

15. An apparatus according to claim 1, wherein said transfer means includes a corona discharging means.

16. An apparatus according to claim 1, further comprising electrostatic attracting means for electrostatically attracting the transfer material on the transfer material carrying means at a position upstream of the transfer position in a conveyance direction of said transfer material carrying means.

17. An apparatus according to claim 1, wherein said transfer means effects plural transfer operations onto the same transfer material.

18. An apparatus according to claim 1, wherein after the image transfer, a full-color image is formed on the transfer material.

19. An apparatus according to claim 3, wherein said image forming means includes latent image forming means for forming a latent image on said image bearing member and developing means for developing the latent image with toner.

20. An apparatus according to claim 19, wherein said developing means includes movable developing devices, wherein said developing devices are selectively presented before said image bearing member when said transfer means effects the transfer operation to the transfer material, and when the transfer material having a toner image is at the transfer position.

21. An apparatus according to claim 3, wherein the transfer material is contacted to a portion of said image bearing member where no image is formed, when said transfer means does not effect the transfer operation onto the transfer material and when the transfer material having the toner image is at the transfer position.

22. An apparatus according to claim 2, wherein the portion of said image bearing member is a portion thereof where the latent image is not formed.

23. An apparatus according wherein the different amounts of electric charge is such that the amount for the end portion of the transfer material is smaller.

24. An apparatus according to claim 1, wherein the difference is provided by changing the output power of said transfer means.

25. An apparatus according to claim 1, wherein said transfer material carrying means has an endless path to repeatedly conveying the transfer material to the transfer position.

26. An image forming apparatus, comprising:

a movable image bearing member;

image forming means for forming a toner image on said image bearing member;

transfer means for electrostically transferring the toner image from said image bearing member onto a transfer material at an image transfer position;

transfer material carrying means for carrying the transfer material to the transfer position;

wherein said transfer means produces different outputs per unit area to an end of the transfer material in a direction of conveyance of the transfer material by said transfer material carrying means and to another portion of the transfer material, wherein said transfer material carrying means has a carrying surface made of dielectric material.

27. An apparatus according to claim 26, wherein said transfer means supplies the different amounts of outputs during an image transfer operation to the transfer material.

28. An apparatus according to claim 26, wherein said transfer means supplies the different outputs when the transfer material having a toner image is at the transfer position not for transferring another toner image onto the transfer material.

29. An apparatus according to claim 26, wherein the end portion is a leading end portion of the transfer material in a conveyance direction of said transfer material carrying means.

30. An apparatus according to claim 26, wherein the end portion is a trailing end portion of the transfer material in a conveyance direction of said transfer material carrying means.

31. An apparatus according to claim 26, wherein a peripheral length of said image bearing member measured in a direction of its movement is smaller than a maximum length of the transfer material measured in a conveyance direction of said transfer material carrying means.

32. An apparatus according to claim 26, wherein said image forming means includes latent image forming means for forming a latent image on said image bearing member and developing means for developing the latent image with toner.

33. An apparatus according to claim 32, wherein said transfer means has a charging polarity which is opposite to a polarity of the latent image.

34. An apparatus according to claim 33, wherein said image bearing member is a photosensitive member, and said latent image forming means includes exposure means for exposing the photosensitive member in accordance with the image information.

35. An apparatus according to claim 34, herein said photosensitive member has a layer made of organic photoconductive.

36. An apparatus according to claim 26, further comprising discharge means having a polarity opposite to that of said transfer means, and disposed opposed to said transfer material carrying means downstream of said transfer material carrying means in a direction of conveyance of the transfer material.

37. An apparatus according to claim 36, wherein said discharging means applies electric discharge to the transfer material carried on said transfer material carrying means when the end portion of the transfer material is at the transfer position.

38. An apparatus according to claim 37, wherein said discharging means discharges a larger amount of electric discharge when the end portion of the transfer material is at the transfer position than when another portion of the transfer material is at the transfer position.

39. An apparatus according to claim 27, wherein when said transfer means effects its transfer operation onto the transfer material, the end portion of the transfer material is contacted to a portion of said image bearing member where no image is formed.

40. An apparatus according to claim 26, herein said transfer means includes a corona discharging means.

41. An apparatus according to claim 26, further comprising electrostatic attracting means for electrostatically attracting the transfer material on said transfer material carrying means at a position upstream of the transfer position in a conveyance direction of said transfer material carrying means.

42. An apparatus according to claim 26, wherein said transfer means effects plural transfer operations onto the same transfer material.

43. An apparatus according to claim 26 wherein after the image transfer, a full-color image is formed on the transfer material.

44. An apparatus according to claim 28, wherein said image forming means includes latent image forming means for forming a latent image on said image bearing member and developing means for developing the latent image with toner.

45. An apparatus according to claim 44, wherein said developing means includes movable developing devices, wherein said are selectively presented before said image bearing member when said transfer means effects the transfer operation to the transfer material, and when the transfer material having a toner image is at the transfer position.

46. An apparatus according to claim 28, wherein the transfer material is contacted to a portion of said image bearing member where no image is formed, when said transfer means does not effect the transfer operation onto the transfer material and when the transfer material having the toner image is at the transfer position.

47. An apparatus according to claim 28, wherein the portion of said image bearing member is a portion thereof where the latent image is not formed.

48. An apparatus according to claim 26, wherein the different outputs is such that the output for the end portion of the transfer material is smaller.

49. An apparatus according to claim 26, wherein the output of the transfer means is the output current.

50. An apparatus according to claim 26, wherein said transfer material carrying means has an endless path to repeatedly conveying the transfer material to the transfer position.

51. An image forming apparatus, comprising:

a movable image bearing member;

image forming means for forming a toner image on said image bearing member;

transfer means for electrostrostatically transferring the toner image from said image bearing member onto a transfer material at an image transfer position;

transfer material carrying means for carrying the transfer material to the transfer position;

wherein said transfer means supplies different electric charge amounts per unit area to an end portion of the transfer material in a direction of conveyance of the transfer material by said transfer material carrying means and to another portion of the transfer material; and wherein the end portion is a trailing end portion of the transfer material in a conveyance direction of said transfer material carrying means.

52. An apparatus according to claim 51, wherein said transfer means effects plural transfer operations onto the same transfer material.

53. An image forming apparatus, comprising:

a movable image bearing member;

image forming means for forming a toner image on said image bearing member;

transfer means for electrostatically transferring the toner image from said image bearing member onto a transfer material at an image transfer position;

transfer material carrying means for carrying the transfer material to the transfer position;

wherein said transfer means supplies different electric charge amounts per unit area to an end portion of the transfer material in a direction of conveyance of the transfer material by said transfer material carrying means and to another portion of the transfer material; and wherein said transfer means effects plural transfer operations onto the same transfer material.

54. An apparatus according to claim 51 or 53, wherein the different amounts of electric charge is such that the amount for the end portion of the transfer material is smaller.

55. An image forming apparatus, comprising:

a movable image bearing member;

image forming means for forming a toner image on said image bearing member;

transfer means for electrostatically transferring the toner image from said image bearing member onto a transfer material at an image transfer position;

transfer material carrying means for carrying the transfer material to the transfer position;

wherein said transfer means supplies different electric charge amounts per unit area to an end portion of the transfer material in a direction of conveyance of the transfer material by said transfer material carrying means and to another portion of the transfer material; and wherein the different amounts of electric charge is such that the amount for the end portion of the transfer material is smaller.

56. An apparatus according to claims 51, 53 or 55, wherein said transfer means supplies the different amounts of electric charge during an image transfer operation to the transfer material.

57. An apparatus according to claims 51, 53 or 55, wherein said transfer means supplies the different amounts of electric charge when the transfer material having a toner image is at the transfer position not for transferring another toner image onto the transfer material.

58. An apparatus according to claims 53 or 55, wherein the end portion is a leading end portion of the transfer material in a conveyance direction of said transfer material carrying means.

59. An apparatus according to claims 51, 53 or 55, wherein a peripheral length of said image bearing member measured in a direction of its movement is smaller than a maximum length of the transfer material measured in a conveyance direction of said transfer material carrying means.

60. An apparatus according to claims 51, 53 or 55, wherein said image forming means includes latent image forming means for forming a latent image on said image bearing member and developing means for developing the latent image with toner.

61. An apparatus according to claim 60, wherein said transfer means has a charging polarity which is opposite to a polarity of the latent image.

62. An apparatus according to claim 61, wherein said image bearing member is a photosensitive member, and said latent image forming means includes exposure means for exposing the photosensitive member in accordance with the image information.

63. An apparatus according to claim 62, wherein the photosensitive member has a layer made of organic photoconductive.

64. An apparatus according to claims 51, 53 or 55, further comprising discharge means having a polarity opposite to that of said transfer means, and disposed opposed to said transfer material carrying means downstream of said transfer material carrying means in a direction of conveyance of the transfer material.

65. An apparatus according to claim 64, wherein said discharging means applies electric discharge to the transfer material carried on said transfer material carrying means when the end portion of the transfer material is at the transfer position.

66. An apparatus according to claim 65, wherein said discharging means discharge a larger amount of electric discharge when the end portion of the transfer material is at the transfer position than when another portion of the transfer material is at the transfer position.

67. An apparatus according to claim 56, wherein when said transfer means effects its transfer operation onto the transfer material, the end portion of the transfer material is contacted to a portion of said image bearing member where no image is formed.

68. An apparatus according to claims 51, 53 or 55, wherein said transfer means includes corona discharging means.

69. An apparatus according to claims 51, 53 or 55, further comprising electrostatic attracting means for electrostatically attracting the transfer material on the transfer material carrying means at a position upstream of the transfer position in a conveyance direction of said transfer material carrying means.

70. An apparatus according to claims 53, 55 or 52, wherein the toner is a color toner.

71. An apparatus according to claim 57, wherein said image forming means includes latent image forming means for forming a latent image on said image bearing member and developing means for developing the latent image with toner.

72. An apparatus according to claim 71 wherein said developing means includes movable developing devices, wherein said developing devices are selectively presented before said image bearing member when said transfer means effects the transfer operation to the transfer material, and when the transfer material having a toner image is at the transfer position.

73. an apparatus according to claim 57, wherein the transfer material is contacted to a portion of said image bearing member where no image is formed, when said transfer means does not effect the transfer operation onto the transfer material and when the transfer material having the toner image is at the transfer position.

74. An apparatus according to claim 73, wherein the portion of said image bearing member is a portion thereof where the latent image is not formed.

75. An apparatus according to claim 51, 53 or 55, wherein the difference is provided by changing the output power of said transfer means.

76. An apparatus according to claim 51, 53 or 55, wherein said transfer material carrying means has an endless path to repeatedly conveying the transfer material to the transfer position.

77. An image forming apparatus comprising:
a movable image bearing member;
image forming means for forming a toner image on said image bearing member;
transfer means for electrostatically transferring the toner image from said image bearing member onto a transfer material at an image transfer position;
transfer material carrying means for carrying the transfer material to the transfer position;
wherein said transfer means produces different outputs per unit area to an end of the transfer material in a direction of conveyance of the transfer material by said transfer material carrying means and to another portion of the transfer material; and
wherein the end portion is a trailing end portion of the transfer material in a conveyance direction of said transfer material carrying means.

78. An apparatus according to claim 77, wherein said transfer means effects plural transfer operations onto the same transfer material.

79. An image forming apparatus comprising:
a movable image bearing member;
image forming means for forming a toner image on said image bearing member;
transfer means for electrostatically transferring the toner image from said image bearing member onto a transfer material at an image transfer position;
transfer material carrying means for carrying the transfer material to the transfer position;
wherein said transfer means produces different outputs per unit area to an end of the transfer material in a direction of conveyance of the transfer material by said transfer material carrying means and to another portion of the transfer material; and
wherein said transfer means effects plural transfer operations onto the same transfer material.

80. An apparatus according to claim 77 or 79, wherein the different outputs is such that the output for the end portion of the transfer material is smaller.

81. An image forming apparatus comprising:
a movable image bearing member;
image forming means for forming a toner image on said image bearing member;
transfer means for electrostatically transferring the toner image from said image bearing member onto a transfer material at an image transfer position;
transfer material carrying means for carrying the transfer material to the transfer position;
wherein said transfer means produces different outputs per unit area to an end of the transfer material in a direction of conveyance of the transfer material by said transfer material carrying means and to another portion of the transfer material; and wherein the different outputs is such that the output for the end portion of the transfer material is smaller.

82. An apparatus according to claim 77, 79, or 81, wherein said transfer means supplies the different amounts of outputs during an image transfer operation to the transfer material.

83. An apparatus according to claim 77, 79 or 81, wherein said transfer means supplies the different outputs when the transfer material having a toner image is at the transfer position not for transferring another toner image onto the transfer material.

84. An apparatus according to claim 79 or 81, wherein the end portion is a leading end portion of the transfer material in a conveyance direction of said transfer material carrying means.

85. An apparatus according to claim 77, 79 or 81, wherein a peripheral length of said image bearing member measured in a direction of its movement is smaller than a maximum length of the transfer material measured in a conveyance direction of said transfer material carrying means.

86. An apparatus according to claim 77, 79 or 81, wherein said image forming means includes latent image forming means for forming a latent image on said image bearing member and developing means for developing the latent image with toner.

87. An apparatus according to claim 86, wherein said transfer means has a charging polarity which is opposite to a polarity of the latent image.

88. An apparatus according to claim 87, wherein said image bearing member is a photosensitive member, and said latent image forming means includes exposure means for exposing said photosensitive member in accordance with the image information.

89. An apparatus according to claim 88, wherein said photosensitive member has a layer made of organic photoconductive.

90. An apparatus according to claim 77, 79 or 81, further comprising discharge means having a polarity opposite to that of said transfer means, and disposed opposed to said transfer material carrying means downstream of said transfer material carrying means in a direction of conveyance of the transfer position.

91. An apparatus according to claim 90, wherein said discharging means applies electric discharge to the transfer material carried on said transfer material carrying means when the end portion of the transfer material is at the transfer position.

92. An apparatus according to claim 91, wherein said discharging means discharges a larger amount of electric discharge when the end portion of the transfer material is at the transfer position than when another portion of the transfer material is at the transfer position.

93. An apparatus according to claim 82, wherein when said transfer means effects its transfer operation onto the transfer material, the end portion of the transfer material is contacted to a portion of said image bearing member where no image is formed.

94. An apparatus according to claim 77, 79 or 81, wherein said transfer means includes corona discharging means.

95. An apparatus according to claim 77, 79 or 81, further comprising electrostatic attracting means for electrostatically attracting the transfer material on said transfer material carrying means at a position upstream of the transfer position in a conveyance direction of said transfer material carrying means.

96. An apparatus according to claim 79, 81 or 78, wherein the toner is a color toner.

97. An apparatus according to claim 83, wherein said image forming means includes latent image forming means for forming a latent image on said image bearing member and developing means for developing the latent image with toner.

98. An apparatus according to claim 97, wherein said developing means includes movable developing device, wherein said developing devices are selectively presented before said image bearing member when said transfer means effects the transfer operation to the transfer material, and when the transfer material having a toner image is at the transfer position.

99. An apparatus according to claim 83, wherein the transfer material is contacted to a portion of said image bearing member where no image is formed, when said transfer means does not effect the transfer operation onto the transfer material and when the transfer material having the toner image is at the transfer position.

100. An apparatus according to claim 99, wherein the portion of said image bearing member is a portion thereof where the latent image is not formed.

101. An apparatus according to claim 77, 79 or 81, wherein the output of said transfer means is the output current.

102. An apparatus according to claim 77, 79 or 81, wherein said transfer material carrying means has an endless path to repeatedly conveying the transfer material to the transfer position.

103. An apparatus according to claim 81, wherein said transfer means provides its output for the edge of the transfer material.

* * * * *

UNITED STATES PATENT AND TRADEMARK OFFICE

CERTIFICATE OF CORRECTION

PATENT NO. : 5,083,167

DATED : January 21, 1992

INVENTOR(S) : FUKUSHIMA, et al.

It is certified that error appears in the above-identified patent and that said Letters Patent is hereby corrected as shown below:

IN THE DRAWINGS

FIGURE 11

"LATANT" should read -- LATENT --.
"WEAKNING" should read -- WEAKENING --.

COLUMN 1

Line 41, "to" should be deleted.

COLUMN 2

Line 12, "operation is" should read -- operations are --.
Line 16, "char-" should read -- dischar --.
Line 17, "charger 5e." should read -- discharger 5e. --.
Line 25, "above-type" should read -- above type --.
Line 29, "and" should be deleted.
Line 52, "$110^{13}$ ohm.cm," should read -- $10^{13}$ ohm.cm --.
Line 59, "thereof" should be deleted.
Line 63, "between" should read -- between it and --.

COLUMN 3

Line 7, "can not" should read -- cannot --.
Line 46, "material" should read -- material. --.

COLUMN 4

Line 65, "-300--900V," should read -- -300 to -900V, --.
Line 66, "-50--200V," should read -- -50 to -200V, --.

UNITED STATES PATENT AND TRADEMARK OFFICE

CERTIFICATE OF CORRECTION

PATENT NO. : 5,083,167

DATED : January 21, 1992

INVENTOR(S) : FUKUSHIMA, et al.

It is certified that error appears in the above-identified patent and that said Letters Patent is hereby corrected as shown below:

COLUMN 5

Line 1, "to" (second occurrence) should be deleted.
Line 35, "sheet 16" should read -- sheet 16a --.
Line 46, "opposed" should read -- opposed to --.
Line 62, "Vaals" should read -- Waals --.
Line 67, "roller," should read -- roller 118, --.

COLUMN 6

Lines 4-7, Italics should be deleted.
Line 15, "an" should read -- can --.
Line 16, "sheet 16aa." should read -- sheet 16a. --.
Line 32, "rollers 21" should read -- rollers 121 --.

COLUMN 7

Line 13, "developing 14c" should read -- developing device 14c --.
Line 22, "drum 1" should read -- drum 11 --.

COLUMN 8

Line 8, "is" should be deleted.
Line 32, "as" should read -- is --.
Line 37, "providing" should read -- provides --.
Line 39, "result" should read -- resulting --.

UNITED STATES PATENT AND TRADEMARK OFFICE

CERTIFICATE OF CORRECTION

PATENT NO. : 5,083,167

DATED : January 21, 1992

INVENTOR(S) : FUKUSHIMA, et al.

It is certified that error appears in the above-identified patent and that said Letters Patent is hereby corrected as shown below:

COLUMN 9

Line 18, "discharger 11" should read -- discharger 111 --.
Line 67, "on-image-forming" should read -- non-image-forming --.

COLUMN 10

Line 5, "discharger 11" should read -- discharger 111- --.
Line 6, "interfered" should read -- interfere --.
Line 22, "10014 200" should read -- 100-200 --.

COLUMN 11

Line 22, "to" should be deleted.
Line 23, "to" should be deleted.
Line 39, "drum 5b" should read -- drum 5 --.
Line 45, "-300--900V." should read -- -300 to -900V. --.
Line 58, "in transfer" should read -- in the cylinder 5a to constitute the transfer means and a transfer --.
Line 68, "+5 KV - 30 9 KV," should read -- +5 KV to +9 KV, --.

UNITED STATES PATENT AND TRADEMARK OFFICE

CERTIFICATE OF CORRECTION

PATENT NO. : 5,083,167

DATED : January 21, 1992

INVENTOR(S) : FUKUSHIMA, et al.

It is certified that error appears in the above-identified patent and that said Letters Patent is hereby corrected as shown below:

COLUMN 12

Line 2, "ampere-" should read -- ampere to --.
Line 14, "to" should be deleted.
Line 23, "is" should read -- which is --.
Line 27, "+20˜ +100" should read --+20 to +100--.
Line 29, "+100˜ +500" should read --+100 to +500--.
Line 60, "moves" should read -- moving --.
Line 61, "drum 1" should read -- drum 1, which is --.

COLUMN 13

Line 11, "opposite" should read -- opposite the --.

COLUMN 14

Line 29, "position;" should read -- position; and --.
Line 31, "position;" should read -- position, --.

COLUMN 15

Line 11, "photoconductive." should read -- photoconductive material. --.
Line 23, "claim 13," should read -- claim 12, --.
Line 35, "a" should be deleted.
Line 66, "claim 2," should read -- claim 21, --.

UNITED STATES PATENT AND TRADEMARK OFFICE

CERTIFICATE OF CORRECTION

PATENT NO. : 5,083,167

DATED : January 21, 1992

INVENTOR(S) : FUKUSHIMA, et al.

It is certified that error appears in the above-identified patent and that said Letters Patent is hereby corrected as shown below:

COLUMN 16

Line 1, "according" should read -- according to claim 1, --.
Line 2, "is" should read -- are --.
Line 9, "conveying" should read -- convey --.
Line 11, "apparatus," should read -- apparatus --.
Line 15, "electrostically" should read -- electrostatically --.
Line 17, "position;" should read -- position; and --.
Line 19, "position;" should read -- position, --.
Line 63, "herein" should read -- wherein --.
Line 65, "photoconductive." should read -- photoconductive material. --.

COLUMN 17

Line 20, "herein" should read -- wherein --.
Line 21, "a" should be deleted.
Line 31, "claim 26" should read -- claim 26, --.
Line 41, "said are" should read -- said developing devices are --.
Line 57, "is" should read -- are --.
Line 60, "the" (1st. occ.) should read --said--
Line 63, "conveying" should read -- convey --.

COLUMN 18

Line 4, "tion;" should read -- tion; and --.
Line 25, "position;" should read -- position; and --.
Line 38, "is" should read -- are --.
Line 47, "position;" should read -- position; and --.
Line 56, "is" should read -- are --.

UNITED STATES PATENT AND TRADEMARK OFFICE

CERTIFICATE OF CORRECTION

PATENT NO. : 5,083,167

DATED : January 21, 1992

INVENTOR(S) : FUKUSHIMA, et al.

It is certified that error appears in the above-identified patent and that said Letters Patent is hereby corrected as shown below:

COLUMN 19

Line 26, "photoconductive." should read -- photoconductive material. --.
Line 39, "discharge" should read -- discharges --.
Line 64, "claim 71" should read -- claim 71, --.

COLUMN 20

Line 3, "an" should read -- An --.
Line 17, "conveying" should read -- convey --.
Line 25, "position;" should read -- position; and --.
Line 27, "position;" should read -- position, --.
Line 45, "position;" should read -- position; and --.
Line 47, "position;" should read -- position, --.
Line 56, "is" should read -- are --.
Line 64, "position;" should read -- position; and --.
Line 66, "position;" should read -- position, --.

COLUMN 21

Line 4, "is" should read -- are --.
Line 43, "photoconductive." should read -- photoconductive material. --.

UNITED STATES PATENT AND TRADEMARK OFFICE

CERTIFICATE OF CORRECTION

PATENT NO. : 5,083,167 Page 7 of 7

DATED : January 21, 1992

INVENTOR(S) : FUKUSHIMA, et al.

It is certified that error appears in the above-identified patent and that said Letters Patent is hereby corrected as shown below:

COLUMN 22

Line 29, "device," should read -- devices, --.
Line 49, "conveying" should read -- convey --.

Signed and Sealed this

Twenty-sixth Day of April, 1994

Bruce Lehman

*Attest:*

BRUCE LEHMAN

*Attesting Officer*

*Commissioner of Patents and Trademarks*